US006280485B1

(12) United States Patent
Daly et al.

(10) Patent No.: US 6,280,485 B1
(45) **Date of Patent: *Aug. 28, 2001**

(54) EMULSIFIED WATER-BLENDED FUEL COMPOSITIONS

(75) Inventors: Daniel T. Daly, Solon; John J. Mullay, Mentor; Elizabeth A. Schiferl, Euclid; Deborah A. Langer, Chesterland; David L. Westfall, Lakewood; Harshida Dave, Highland Heights; Brian B. Filippini, Mentor-on-the-Lake; William D. Abraham, South Euclid, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/391,103

(22) Filed: Sep. 7, 1999

Related U.S. Application Data

(63) Continuation-in-part of application No. 09/152,852, filed on Sep. 14, 1998.

(51) Int. Cl.[7] ..... C10L 1/32

(52) U.S. Cl. ..... 44/301; 44/302; 44/331; 44/386

(58) Field of Search ..... 44/301, 302, 331, 44/386

(56) References Cited

U.S. PATENT DOCUMENTS

| | | | |
|---|---|---|---|
| 2,858,200 | 10/1958 | Broughten . | |
| 3,756,794 | 9/1973 | Ford . | |
| 3,818,876 | 6/1974 | Voogd | 123/25 R |
| 4,048,080 | 9/1977 | Lee et al. . | |
| 4,084,940 | 4/1978 | Lissant . | |
| 4,207,078 | 6/1980 | Sweeney et al. . | |
| 4,329,249 | 5/1982 | Forsberg . | |
| 4,447,348 | 5/1984 | Forsberg . | |
| 4,452,712 | 6/1984 | Laemmle . | |
| 4,482,356 | 11/1984 | Hanlon . | |
| 4,561,861 | 12/1985 | Davis et al. . | |
| 4,585,461 | 4/1986 | Gorman . | |
| 4,613,341 | 9/1986 | Zaweski et al. . | |
| 4,708,753 | 11/1987 | Forsberg . | |
| 4,892,562 | 1/1990 | Bowers et al. . | |
| 4,907,368 | 3/1990 | Mullay et al. . | |
| 4,908,154 | 3/1990 | Cook et al. | 252/314 |
| 5,000,757 | 3/1991 | Puttock et al. | 44/301 |
| 5,047,175 | 9/1991 | Forsberg . | |
| 5,279,626 | 1/1994 | Cunningham et al. . | |
| 5,352,377 | 10/1994 | Blain et al. . | |
| 5,360,458 | 11/1994 | Forsberg et al. . | |
| 5,389,111 | 2/1995 | Nikanjam et al. . | |
| 5,389,112 | 2/1995 | Nikanjam et al. . | |
| 5,454,964 | 10/1995 | Blackborow et al. . | |
| 5,501,714 | 3/1996 | Valentine et al. . | |
| 5,503,772 | 4/1996 | Rivas et al. . | |
| 5,584,894 | 12/1996 | Peter-Hoblyn et al. . | |
| 5,669,938 | 9/1997 | Schwab . | |
| 5,743,922 | 4/1998 | Peter-Hoblyn | 44/30 |
| 5,820,640 | 10/1998 | Ikura et al. . | |
| 5,873,916 | 2/1999 | Cemenska et al. | 44/301 |
| 5,879,419 | 3/1999 | Moriyama et al. . | |
| 6,068,670 | 5/2000 | Haupais et al. | 44/301 |

FOREIGN PATENT DOCUMENTS

| | | | | |
|---|---|---|---|---|
| 711348 | * | 3/1997 | (AU) | 1/32 |
| 0561600 | | 9/1983 | (EP) . | |
| 0475620 | | 3/1992 | (EP) . | |

OTHER PUBLICATIONS

Coughanowr et al.; "Process Systems Analysis and Control"; McGraw–Hill Book Company; 1965, pp. ix–x.

Becher; "Technique of Emulsification"; Emulsions: Theory and Practice; Second Edition, pp. 267–325; 1965.

PCT International Application PCT/US99/20436, Written Opinion, mailed Jul. 31, 2000.

International Search Report, International Application No. PCT/US 99/20436, dated Nov. 1, 2000.

* cited by examiner

*Primary Examiner*—Jerry D. Johnson
(74) *Attorney, Agent, or Firm*—Michael F. Esposito, Esq.; Teresan W. Gilbert, Esq.

(57) ABSTRACT

This invention relates to an emulsified water-blended fuel composition comprising: (A) a hydrocarbon boiling in the gasoline or diesel range; (B) water; (C) a minor emulsifying amount of at least one fuel-soluble salt made by reacting (C)(I) at least one acylating agent having about 16 to 500 carbon atoms with (C)(II) ammonia and/or at least one amine; and (D) about 0.001 to about 15% by weight of the water-blended fuel composition of a water soluble, ashless, halogen-, boron-, and phosphorus-free, amine salt, distinct from component (C). In one embodiment, the composition further comprises (E) at least one cosurfactant distinct from component (C); in one embodiment, (F) at least one organic cetane improver; and in one embodiment, (G) at least one antifreeze. The invention also relates to a method for fueling an internal combustion engine comprising fueling said engine with the composition of the present invention.

11 Claims, 2 Drawing Sheets

EMULSIFIED WATER-BLENDED FUEL COMPOSITIONS

This application is a continuation-in-part of U.S. application Ser. No. 09/152,852, filed Sep. 14, 1998, the disclosure of said application being incorporated herein by reference in its entirety.

BACKGROUND OF THE INVENTION

The present invention relates to emulsified water-blended fuel compositions, more particularly to water-blended fuel compositions containing a liquid fuel, water, an emulsifier, and an amine salt which may function as an emulsion stabilizer or combustion modifier. In one embodiment of the invention, the composition further comprises an organic cetane improver, and in one embodiment an antifreeze.

DESCRIPTION OF THE RELATED ART

Internal combustion engines, especially diesel engines using a mixture of water and fuel in the combustion chamber can produce lower NOx, hydrocarbon and particulate emissions per unit of power output. Water is inert toward combustion, but acts to lower peak combustion temperatures which results in less NOx formation. Exhaust Gas Recirculation (EGR) works on the same principle (i.e., inert materials tend to lower peak combustion temperatures and hence reduce NOx). Water can be separately injected into the cylinder, but hardware costs are high. Water can also be added to the fuel as an emulsion. However, emulsion stability has historically been a problem.

It would be advantageous to provide a water-blended fuel composition that has improved emulsion stability. The present invention provides such an advantage.

U.S. Pat. No. 5,669,938, Schwab, Sep. 23, 1997, discloses a fuel composition which consists of (i) a water-in-oil emulsion comprising a major proportion of a hydrocarbonaceous middle distillate fuel and about 1 to 40 volume percent water, (ii) a CO emission, and particulate matter emission reducing amount of at least one fuel-soluble organic nitrate ignition improver, and optionally containing (iii) at least one component selected from the group consisting of di-hydrocarbyl peroxides, surfactants, dispersants, organic peroxy esters, corrosion inhibitors, antioxidants, antirust agents, detergents, lubricity agents, demulsifiers, dyes, inert diluents, and a cyclopentadienyl manganese tricarbonyl compound.

European Patent EP 0 475 620 B1, Sexton et al., Aug. 11, 1995, discloses a diesel fuel composition which comprises: (a) a diesel fuel; (b) 1.0 to 30.0 weight percent of water based upon said diesel fuel; (c) a cetane number improver additive, present in an amount up to, but less than, 20.0 weight percent based upon said water, said additive being selected from an inorganic oxidizer, a polar organic oxidizer and a nitrogen oxide-containing compound; and (d) 0.5 to 15.0 wt. % based on the diesel fuel of a surfactant system comprising (i) one or more first surfactants selected from surfactants capable of forming a lower phase microemulsion at 20° C. when combined with equal volumes of the fuel and water at a concentration of 2 grams of surfactant per deciliter of fuel plus water, which microemulsion phase has a volume ratio of water to surfactant of at least 2; at least one said first surfactant being an ethoxylated $C_{12}$–$C_{18}$ alkyl ammonium salt of a $C_9$–$C_{24}$ alkyl carboxylic or alkylaryl sulfonic acid containing 6 or more ethylene oxide groups; and (ii) one or more second surfactants selected from surfactants capable of forming an upper phase microemulsion at 20° C. when combined with equal volumes of the fuel and water at a concentration of 2 grams of surfactant per deciliter of fuel plus water, which microemulsion phase has a volume ratio of water to surfactant of at least 2; at least one said surfactant being an ethoxylated $C_{12}$–$C_{18}$ alkyl ammonium salt of $C_9$–$C_{24}$ alkyl carboxylic or alkylaryl sulfonic acid containing less than 6 ethylene oxide groups; the said first and second surfactants being present in a weight ratio which forms with components (a), (b) and (c) a single phase translucent microemulsion.

European patent publication EP 0 561 600 A2, Jahnke, Sep. 22, 1993, discloses a water in oil emulsion comprising a discontinuous aqueous phrase comprising at least one oxygen-supplying component (such as ammonium nitrate); a continuous organic phase comprising at least one carbonaceous fuel; and a minor emulsifying amount of at least one emulsifier made by the reaction of:

(A) at least one substituted succinic acylating agent, said substituted acylating agent consisting of substituent groups and succinic groups wherein the substituent groups are derived from a polyalkene, said acylating agents being characterized by the presence within their structure of an average of at least 1.3 succinic groups for each equivalent weight of substituent groups, and (B) ammonia and/or at least one amine.

U.S. Pat. No. 5,047,175, Forsberg, Sep. 10, 1991, discloses salt compositions which comprise: (A) at least one salt moiety derived from (A)(I) at least one high-molecular weight polycarboxylic acylating agent, said acylating agent (A)(I) having at least one hydrocarbyl substituent having an average of from about 20 to about 500 carbon atoms, and (A)(II) ammonia, at least one amine, at least one alkali or alkaline earth metal, and/or at least one alkali or alkaline earth metal compound; (B) at least one salt moiety derived from (B)(I) at least one low-molecular weight polycarboxylic acylating agent, said acylating agent (B)(i) optionally having at least one hydrocarbyl substituent having all average of up to about 18 carbon atoms, and (B)(II) ammonia, at least one amine, at least one alkali or alkaline earth metal, and/or at least one alkali or alkaline earth metal compound; said components (A) and (B) being coupled together by (C) at least one compound having (i) two or more primary amino groups, (ii) two or more secondary amino groups, (iii) at least one primary amino group and at least one secondary amino group, (iv) at least two hydroxyl groups or (v) at least one primary or secondary amino group and at least one hydroxyl group. These salt compositions are disclosed to be useful as emulsifiers in water-in-oil explosive emulsions, particularly cap-sensitive water-in-oil emulsions.

U.S. Pat. No. 4,708,753, Forsberg, Nov. 24, 1987, discloses a water-in-oil emulsion comprising (A) a continuous oil phase; (B) a discontinuous aqueous phase; (C) a minor emulsifying amount of at least one salt derived from (C)(I) at least one hydrocarbyl-substituted carboxylic acid or anhydride, or ester or amide derivative of said acid or anhydride, the hydrocarbyl substituent of (C)(I) having an average of from about 20 to about 500 carbon atoms, and (C)(II) at least one amine; and (D) a functional amount of at least one water-soluble, oil-insoluble functional additive dissolved in said aqueous phase; with the proviso that when component (D) is ammonium nitrate, component (C) is other than an ester/salt formed by the reaction of polyisobutenyl ($M_n$=950) succinic anhydride with diethanolamine in a ratio of one equivalent of anhydride to one equivalent of amine.

U.S. Pat. No. 3,756,794, Ford, Sep. 4, 1973, discloses an emulsified fuel composition consisting essentially of (1) a major amount of a hydrocarbon fuel boiling in the range of 20–400° C. as the disperse phase, (2) 0.3% to 5% by weight of an emulsifier, (3) 0.75% to 12% by weight water, (4) 0.3% to 0.7% by weight of urea as emulsion stabilizer and (5) 0.3% to 0.7% by weight of ammonium nitrate.

SUMMARY OF THE INVENTION

This invention relates to an emulsified water-blended fuel composition comprising: (A) a hydrocarbon boiling in the gasoline or diesel range; (B) water;

(C) a minor emulsifying amount of at least one fuel-soluble salt made by reacting (C)(I) at least one acylating agent having about 16 to 500 carbon atoms with (C)(II) ammonia and/or at least one amine; and (D) about 0.001 to about 150% by weight of the water-blended fuel composition of a water-soluble, ashless, halogen-, boron-, and phosphorus-free amine salt, distinct from component (C). In one embodiment, the composition further comprises (E) at least one cosurfactant distinct from component (C); in one embodiment, (F) at least one organic cetane improver; and in one embodiment, (G) at least one antifreeze. The invention also relates to a method for fueling an internal combustion engine comprising fueling said engine with the composition of the present invention.

In one embodiment, this invention relates to an emulsified water-blended fuel composition comprising: (A) a hydrocarbon boiling in the gasoline or diesel range; (B) water; (C) a minor emulsifying amount of at least one fuel-soluble salt comprised of (I) a first polycarboxylic acylating agent, said first polycarboxylic acylating agent having at least one hydrocarbyl substituent of about 20 to about 500 carbon atoms, (II) a second polycarboxylic acylating agent, said second polycarboxylic acylating agent optionally having at least one hydrocarbyl substituent of up to about 500 carbon atoms, said polycarboxylic acylating agents (I) and (II) being coupled together by (III) a linking group derived from a linking compound having two or more primary amino groups, two or more secondary amino groups, at least one primary amino group and at least one secondary amino group, at least two hydroxyl groups, or at least one primary or secondary amino group and at least one hydroxyl group, said polycarboxylic acylating agents (1) and (II) forming a salt with (IV) ammonia or an amine; and (D) about 0.001 to about 15% by weight of water-soluble salt distinct from component (C).

BRIEF DESCRIPTION OF THE FIGURES

In FIG. 1(*b*), ammonium nitrate is absent in the additive composition.

DETAILED DESCRIPTION OF THE INVENTION

Figure 1:
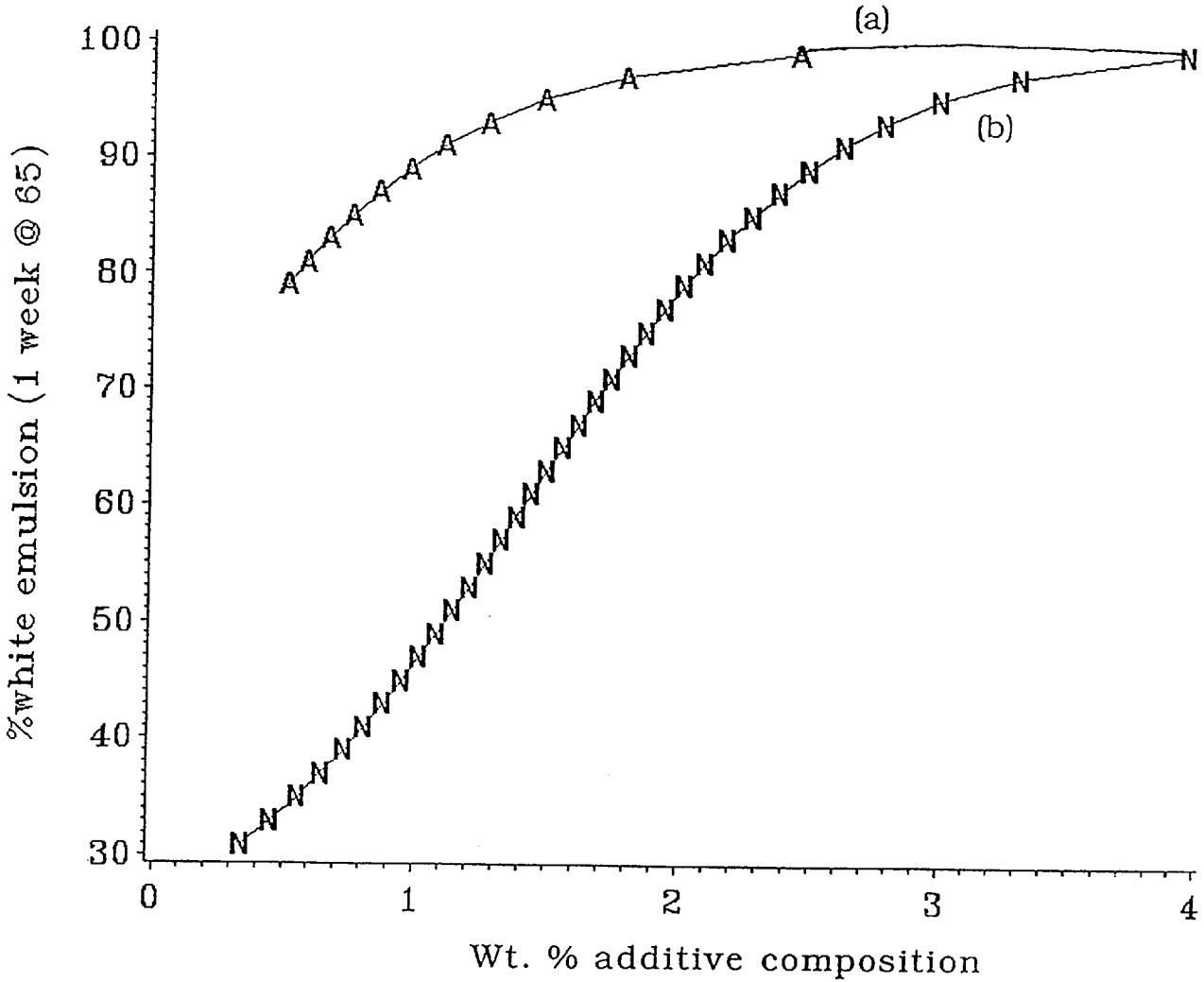
FIG. 1 is a plot of percent white emulsion (indicative of emulsion stability) versus level of additive composition comprising surfactants, an organic nitrate cetane improver, and in one embodiment ammonium nitrate (FIG. 1(*a*)).

As used herein, the term "hydrocarbyl substituent" or "hydrocarbyl group" is used in its ordinary sense, which is well known to those skilled in the art. Specifically, it refers to a group having a carbon atom directly attached to the remainder of the molecule and having predominantly hydrocarbon character.

Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbylene group" refers to a divalent analog of a hydrocarbyl group. Examples of hydrocarbylene groups include ethylene ($—CH_2CH_2—$), propylene (both linear and branched), and 2-octyloxy-1,3-propylene ($—CH_2CH(OC_8H_{17})CH_2—$).

The phrase "reactive equivalent" of a material means any compound or chemical composition other than the material itself that reacts or behaves like the material itself under the reaction conditions. Thus for example, reactive equivalents of carboxylic acids include acid-producing derivatives such as anhydrides, acyl halides, and mixtures thereof unless specifically stated otherwise.

The term "lower" when used in conjunction with terms such as alkyl, alkenyl, and alkoxy, is intended to describe such groups that contain a total of up to 7 carbon atoms.

The term "water-soluble" refers to materials that are soluble in water to the extent of at least one gram per 100 milliliters of water at 25° C.

The term "fuel-soluble" refers to materials that are soluble in fuel (gasoline or diesel) to the extent of at least one gram per 100 milliters of fuel at 25° C. It also refers to materials that end up mostly in the fuel phase when a mixture of a certain quantity of the material and equal volume of fuel and water are mixed together, leaving the water phase substantially (greater than 90%) free of the material.

The present compositions are emulsified water-blended fuel composition. The term "emulsified" refers to the fact that the present composition is present as an emulsion.

In one embodiment of the present composition, the components of the composition are mixed together to form a water-in-fuel emulsion with the hydrocarbon fuel being the continuous phase, and water being the discontinuous phase dispersed in the hydrocarbon fuel phase.

The components of the emulsified water-blended fuel composition are described in detail hereunder.

The Hydrocarbon Fuel (A)

One component of the composition of this invention is a hydrocarbon fuel boiling in the gasoline or diesel range. Motor gasoline is defined by ASTM Specifications D-439-89. It comprises a mixture of hydrocarbons having an ASTM boiling point of 60° C. at the 10% distillation point to about 205° C. at the 90% distillation point. In one embodiment, the gasoline is a chlorine-free or low-chlorine gasoline characterized by a chlorine content of no more than about 10 ppm.

The diesel fuels that are useful with this invention can be any diesel fuel. They include those that are defined by ASTM Specification D396. In one embodiment the diesel fuel has a sulfur content of up to about 0.05% by weight (low-sulfur diesel fuel) as determined by the test method specified in ASTM D 2622-87 entitled "Standard Test Method for Sulfur in Petroleum Products by X-Ray Spectrometry." Any fuel having a boiling range and viscosity suitable for use in a diesel-type engine can be used. These fuels typically have a 90% point distillation temperature in the range of about 300° C. to about 390° C., and in one embodiment about 330° C. to about 350° C. The viscosity for these fuels typically ranges from about 1.3 to about 24 centistokes at 40° C. These diesel fuels can be classified as any of Grade Nos. 1-D, 2-D or 4-D as specified in ASTM D 975 entitled "Standard Specification for Diesel Fuel Oils". These diesel fuels can contain alcohols and esters. In one embodiment, the diesel fuel is a chlorine-free or low-chlorine diesel fuel characterized by a chlorine content of no more than about 10 ppm.

The Acylating Agent (C)(a)

The acylating agent of this invention includes carboxylic acids and their reactive equivalents such as acid halides, anhydrides, and esters, including partial esters and triglycerides. The acylating agent also includes amides. Examples of various acylating agents and their methods are preparation are disclosed in U.S. Pat. No. 4,708,753 ("the '753 patent"), and European Patent Publication EP 0 561 600 A2. In the '753 patent, the acylating agents are described as hydrocarbyl-substituted carboxylic acids, anhydrides, esters and amide derivatives thereof.

The acylating agent contains about 16 to about 500 carbon atoms, and in one embodiment from about 16 to about 30, and in one embodiment, and in one embodiment from about 20 to about 30 carbon atoms, and in one embodiment from about 20 to about 500, and in one embodiment from about 30 to about 500 carbon atoms.

In one embodiment, the carboxylic acid is a monocarboxylic acid of about 16 to about 500 carbon atoms, and in one embodiment about 20 to about 500 carbon atoms, and in one embodiment about 20 to about 30 carbon atoms, and in one embodiment about 30 to 400 carbon atoms, and in one embodiment about 50 to 200 carbon atoms. Examples of these monocarboxylic acids include palmitic acid, stearic acid, linoleic acid, arachidic acid, gadoleic acid, behenic acid, erucic acid, and lignoceric acid. Reactive equivalents of monocarboxylic acids include triglycerides represented by the formula (C-I-1)

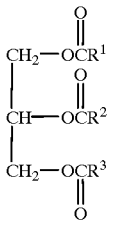

wherein in formula (C-I-1), $R^1$, $R^2$ and $R^3$ are independently hydrocarbyl groups such that the total number of carbon atoms in the triglycerides ranges from about 16 to about 500.

In one embodiment, the acylating agent is made by reacting one or more alpha-beta olefinically unsaturated carboxylic acid reagents containing 2 to about 20 carbon atoms, exclusive of the carboxyl based groups, with one or more olefin polymers containing at least about 20 carbon atoms, as described more fully hereinafter.

The alpha-beta olefinically unsaturated carboxylic acids may be either monobasic or polybasic in nature. Exemplary of the monobasic alpha-beta olefinically unsaturated carboxylic acids include the carboxylic acids corresponding to the formula (C-I-2)

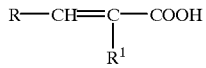

wherein in formula (C-I-2), R is hydrogen, or a saturated aliphatic or alicyclic, aryl, alkylaryl or heterocyclic group, preferably hydrogen or a lower alkyl group, and $R^1$ is hydrogen or a lower alkyl group. The total number of carbon atoms in R and R' should not exceed about 18 carbon atoms. Specific examples of useful monobasic alpha-beta olefinically unsaturated carboxylic acids include acrylic acid; methacrylic acid; cinnamic acid; crotonic acid; 3-phenyl propenoic acid; alpha, and beta-decenoic acid. The polybasic acids are preferably dicarboxylic, although tri- and tetracarboxylic acids can be used. Exemplary polybasic acids include maleic acid, fumaric acid, mesaconic acid, itaconic acid and citraconic acid.

Reactive equivalents of the alpha-beta olefinically unsaturated carboxylic acid reagents include the anhydride, ester or amide functional derivatives of the foregoing acids. A preferred alpha-beta olefinically unsaturated carboxylic acid is maleic anhydride.

In one embodiment, the acylating agent (C)(I) of this invention is a hydrocarbyl-substituted succinic acid or anydride represented correspondingly by the formulae (C-I-3)

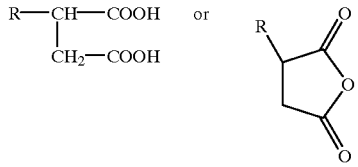

wherein in formula (C-I-3), R is hydrocarbyl group of about 12 to about 496 carbon atoms, and in one embodiment from about 12 to about 16, and in one embodiment from about 16 to about 30, and in one embodiment from about 30 to about 496 carbon atoms. The production of such hydrocarbyl-substituted succinic acids or anhydrides via alkylation of maleic acid or anhydride or its derivatives with a halohydrocarbon or via reaction of maleic acid or anhydride with an olefin polymer having a terminal double bond is well known to those of skill in the art and need not be discussed in detail herein.

In one embodiment, component (C)(I) comprises a mixture of at least two hydrocarbyl substituted succinic acids or anhydrides of formula (C-I-3), wherein at least one R in formula (C-I-3) is a hydrocarbyl group of about 8 to about 25, and in one embodiment about 10 to about 20 carbon atoms, and in one embodiment about 1 6 carbon atoms; and at least one R in formula (C-I-3) is a hydrocarbyl group of about 50 to about 400 carbon atoms, and in one embodiment about 50 to 150 carbon atoms.

The hydrocarbyl group "R" of the substituted succinic acids and anhydrides of formula (C-I-3) can thus be derived from olefin polymers or chlorinated analogs thereof. The olefin monomers from which the olefin polymers are derived are polymerizable olefin monomers characterized by having one or more ethylenic unsaturated groups. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group>C═$CH_2$. However, certain internal olefins can also serve as monomers (these are sometimes referred to as medial olefins). When such medial olefin monomers are used, they normally are employed in combination with terminal olefins to produce olefin polymers that are interpolymers. Although, the hydrocarbyl substituents may also include aromatic groups (especially phenyl groups and lower alkyl and/or lower alkoxy-substituted phenyl groups such as para(tertiary-butyl)-phenyl groups) and alicyclic groups such as would be obtained from polymerizable cyclic olefins or alicyclic-substituted polymerizable cyclic olefins, the hydrocarbyl-based substituents are usually free from such groups. Nevertheless, olefin polymers derived from such interpolymers of both 1,3-dienes and styrenes such as butadiene-1,3 and styrene or para-(tertiary butyl) styrene are exceptions to this general rule.

Generally the olefin polymers are homo- or interpolymers of terminal hydrocarbyl olefins of about 2 to about 30 carbon atoms, and in one embodiment about 2 to about 16 carbon atoms. A more typical class of olefin polymers is selected from that group consisting of homo- and interpolymers of terminal olefins of 2 to about 6 carbon atoms, and in one embodiment 2 to about 4 carbon atoms.

Specific examples of terminal and medial olefin monomers which can be used to prepare the olefin polymers from which the hydrocarbyl-based substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylenetrimer, butadiene-1,2, butadiene-1,3, pentadiene-1,2, pentadiene-1,3, isoprene, hexadiene-1,5, 2-chlorobutadiene-1,3, 2-methylheptene-1,3-cyclohexylbutene-1, 3,3-dimethylpentene-1, styrenedivinylbenzene, vinyl-acetate allyl alcohol, 1-methylvinylacetate, acrylonitrile, ethyl acrylate, ethylvinylether and methyl-vinylketone. Of these, the purely hydrocarbyl monomers are more typical and the terminal olefin monomers are especially typical.

In one embodiment, the olefin polymers are polyisobutylenes such as those obtained by polymerization of a $C_4$ refinery stream having a butene content of about 35 to about 75% by weight and an isobutene content of abolit 30 to about 60% by weight in the presence of a Lewis acid catalyst such as aluminum chloride or boron trifluoride. These polyisobutylenes generally contain predominantly (that is, greater than about 50 percent of the total repeat units) isobutene repeat units of the configuration

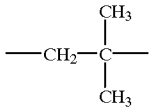

In one embodiment, the hydrocarbyl group R is a polyisobutene group having an average of about 35 to about 400 carbon atoms, and in one embodiment about 50 to about 200 carbon atoms.

Gel permeation chromatography (GPC) (also known as size exclusion chromatography (SEC)) is a method that can provide both weight average and number average molecular weights as well as the entire molecular weight distribution of polymers. For purposes of this invention, a series of fractionated polymers of isobutene (isobutylene) is used as the calibration standard in the GPC. The techniques for determining number average molecular weight ($M_n$) and weight average molecular weight ($M_w$) of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatography", J. Wiley & Sons, Inc., 1979.

In addition to being described in term of carbon numbers, the polyolefin substituents of the hydrocarbyl-substituted succinic acids and anhydrides of this invention can also be described in terms of their number average and/or weight average molecular weights. An approximate method to convert the number average molecular weight of the polyolefin to number of carbon atoms is to divide the number average molecular weight by 14.

In one embodiment, R in formula (C-I-3) is a hexadecenyl group.

In one embodiment, component (C)(I) is at least one hydrocarbyl-substituted succinic acylating agent, said acylating agent consisting of hydrocarbyl substituent groups and succinic groups, wherein the hydrocarblyl-substituent groups are derived from an olefin polymer, and wherein said acylating agent is characterized by the presence within its structure of an average of at least 1.3 succinic groups, and in one embodiment from about 1.5 to about 2.5, and in one embodiment form about 1.7 to about 2.1 for each equivalent weight of the hydrocarbyl substituent. Succinic acylating agents of this type are disclosed in detail in European patent publication EP 0 561 600 A2.

The olefin polymer can be any olefin polymer that h as been described hereinbefore in relation to substituent "R" in formula (C-I-3) above. The "succinic groups" are those groups characterized by the structure (C-I-4)

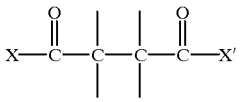

wherein in structure (C-I-4), X and X' are the same or different provided that at least one of X and X' is such that the substituted succinic acylating agent can function as a carboxyl acylating agent. That is, at least one of X and X' must be such that the substituted acylating agent can form, for example, amides, imides or amine salts with amino compounds, and esters, ester-salts, amides, imides, etc., with the hydroxyamines, and otherwise function as a conventional carboxylic acid acylating agent, such as the succinic acids and anhydrides described above. Transesterification and transamidation reactions are considered, for purposes of this invention, as conventional acylating reactions.

Thus, X and/or X' is usually —OH, —O—hydrocarbyl, —)—$M^+$where $M^+$represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X') can enter into acylation reactions.

One of the unsatisfied valences in the grouping

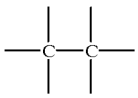

of formula (C-I-4) forms a carbon-carbon bond with a carbon atom in the hydrocarbyl substituent group. While other such unsatisfied valence may be satisfied by a similar bond with the same or different substituent group, all but the said one such valence is usually satisfied by hydrogen; i.e., —H.

For purposes of this invention, the equivalent weight of the hydrocarbyl substituent group of the hydrocarbyl-substituted succinic acylating agent is deemed to be the number obtained by dividing the $M_n$ of the polyolefin from which the hydrocarbyl substituent is derived into the total weight of all the hydrocarbyl substituent groups present in the hydrocarbyl-substituted succinic acylating agents. Thus, if a hydrocarbyl-substituted acylating agent is characterized by a total weight of all hydrocarbyl substituents of 40,000 and the $M_n$ value for the polyolefin from which the hydrocarbyl substituent groups are derived is 2000, then that substituted succinic acylating agent is characterized by a total of 20 (40,000/2000=20) equivalent weights of substituent groups.

The ratio of succinic groups to equivalent of substituent groups presents in the hydrocarbyl-substituted succinic acylating agent (also called the "succination ratio") can be determined by one skilled in the art using conventional techniques (such as from saponification or acid numbers). For example, the formula below can be used to calculate the succination ratio where maleic anhydride is used in the acylation process:

$$SR = \frac{M_n \times (\text{Sap. No. of acylating agent})}{(56100 \times 2) - (98 \times \text{Sap. No. of acylating agent})}$$

wherein in equation 1, SR is the succination ratio, $M_n$ is the number average molecular weight, and Sap. No. is the saponification number. In the above equation, Sap. No. of acylating agent=measured Sap. No. of the final reaction mixture/Al wherein Al is the active ingredient content expressed as a number between 0 and 1, but not equal to zero. Thus an active ingredient content of 80% corresponds to an Al value of 0.8. The Al value can be calculated by using techniques such as column chromatography which can be used to determine the amount of unreacted polyalkene in the final reaction mixture. As a rough approximation, the value of Al is determined after subtracting the percentage of unreacted polyalkene from 100.

In one embodiment, the succinic groups correspond the formula (C-I-5)

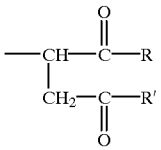

wherein in formula (C-I-5), R and R' are each independently selected from the group consisting of —OH, —Cl, —O—lower alkyl, and when taken together, R and R' and —O—. In the latter case, the succinic group is a succinic anhydride group. All the succinic groups in a particular succinic acylating agent need not be the same, but they can be the same. In one embodiment, the succinic groups correspond to (C-I-6)

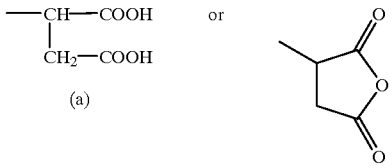

(a) (b)

or mixtures of (C-I-6)(a) and (C-I-6)(b). Providing hydrocarbyl-substituted succinic acylating agents wherein the succinic groups are the same or different is within the ordinary skill of the art and can be accomplished through conventional procedures such as treating the hydrocarbyl substituted succinic acylating agents themselves (for example, hydrolyzing the anhydride to the free acid or converting the free acid to an acid chloride with thionyl chloride) and/or selecting the appropriate maleic or fumaric reactants.

Partial esters of the succinic acids or anhydrides can be prepared simply by the reaction of the acid or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid. A partial ester can be represented by the formula (C-I-7)

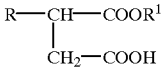

wherein in formula (C-I-7), R is a hydrocarbyl group; and $R^1$ is a hydrocarbyl group, typically a lower alkyl group.

In one embodiment, component (C) of the present invention includes the salt compositions of U.S. Pat. No. 5,047,175 ("the '175 patent), except for those salt compositions of the '175 patent which are derived from reacting alkali metal, alkaline earth metal, alkali metal compound, or alkaline earth metal compounds (which fall within components (A)(II) and (B)(II) of the '175 patent).

Thus in one embodiment of the present invention, component (C)(I) is made by coupling a) at least one polyisobutene substituted succinic acid or anhydride, the polyisobutene substituent of said succinic acid or anhydride having about 50 to about 200 carbon atoms, and in one embodiment about 50 to about 150, and in one embodiment about 70 to about 100 carbon atoms; and b) at least one hydrocarbyl-substituted succinic acid or anhydride, the hydrocarbyl substituent of said succinic acid or anhydride having up about 8 to about 25 carbon atoms, and in one embodiment from about 10 to about 20 carbon atoms, and in one embodiment about 16 carbon atoms; by (c) at least one coupling agent having (i) two or more primary amino groups, (ii) two or more secondary amino groups, (iii) at least one primary amino group and at least one secondary amino group, (iv) at least two hydroxyl groups or (v) at least one primary or secondary amino group and at least one hydroxyl group.

The coupling agent includes those components described under component (C) of the '175 patent, including polyamines, polyols, and hydroxyamines. In one embodiment, the coupling agent of the present invention is ethylene glycol.

In one embodiment the acylating agent (C)(I) comprises at least one compound represented by the formula

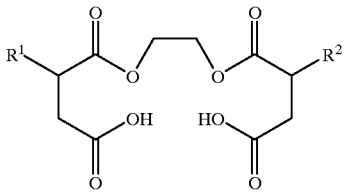

wherein $R^1$ is a polyisobutene group of about 35 to about 300 carbon atoms and $R^2$ is a hydrocarbyl group of about 10 to 20 carbon atoms. This compound can be seen as the result of coupling a $R^1$ substituted succinic acid or anhydride with an $R^2$ substituted succinic acid or anhydride by the coupling agent ethylene glycol.

In addition to the methods described in the '753 patent and in EP 0 561 600 A2 for the preparation of the acylating agents of this invention, such as the one step, two step and direct alkylation procedures, the acylating agents of the present invention can also be made via a direct alkylation procedure that does not use chlorine. Polyisobutene-substituted succinic anhydride produced by such a process is available from Texaco under the name "TLA™-629C."

Component (C)(II)

Component (C)(II) of the present invention includes ammonia and/or at least one amine. The amines useful for reacting with the acylating agent (C)(I) of this invention include monoamines, polyamines, or mixtures of these. These amines are described in detail in the '753 patent.

The monoamines have only one amine functionality whereas the polyamines have two or more. The amines can be primary, secondary or tertiary amines. The primary amines are characterized by the presence of at least one —$NH_2$ group; the secondary by the presence of at least one H—N<group. The tertiary amines are analogous to the primary and secondary amines with the exception that the hydrogen atoms in the —$NH_2$ or H—N<groups are replaced by hydrocarbyl groups. Examples of primary and secondary monoamines include ethylamine, diethylamine, n-butylamine, di-n-butylamine, allylamine, isobutylamine, cocoamine, stearylamine, laurylamine, methyllaurtylamine, oleylamine, N-methylocylamine, dodecylamine, and octadecylamine. Suitable examples of tertiary monoamines include trimethylamine, triethylamine, tripropyl amine, tributylamine, monomethyidimethyl amine, monoethyidimethylamine, dimethylpropyl amine, dimethylbutyl amine, dimethylpentyl amine, dimethylhexyl amine, dimethylheptyl amine, and dimethyloctyl amine.

In one embodiment, the amines (C)(II) are hydroxyamines. These hydroxyamines can be primary, secondary, or tertiary amines. Typically, the hydroxamines are primary, secondary or tertiary alkanolamines, or mixture thereof. Such amines can be represented, respectfully, by the formulae:

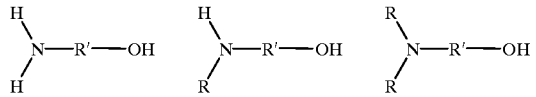

and mixtures of two or more thereof; wherein in the above formulae each R is independently a hydrocarbyl group of 1 to about 8 carbon atoms, or a hydroxyl-substituted hydrocarbyl group of 2 to about 8 carbon atoms and each R' independently is a hydrocarbylene (i.e., a divalent hydrocarbyl) group of 2 to about 18 carbon atoms. The group —R'—OH in such formulae represents the hydroxyl-substituted hydrocarbylene group. R' can be an acyclic, alicyclic, or aromatic group. Typically, R' is an acyclic straight or branched alkylene group such as ethylene, 1,2-propylene, 1,2-butylene, 1,2-octadecylene, etc. group. When two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R is independently a lower alkyl group of up to seven carbon atoms.

Suitable examples of the above hydroxyamines include mono-, di-, and triethanolamine, dimethylethanolamine (N,N-dimethylethanoloamine), diethylethanol-amine (N,N-diethylethanolamine), di-(3-hydroxyl propyl) amine, N-(3-hydroxyl butyl) amine, N-(4-hydroxyl butyl) amine and N,N-di-(2-hydroxyl propyl) amine.

Reaction Between the Acylating agent (C)(I) and the Amine (C)(II)

The product of the reaction between the acylating agent (C)(I) and the amine (C)(II) comprises at least one salt (C). This salt can be an internal salt involving residues of a molecule of the acylating agent (C)(I), and the amine (C)(II), wherein one of the carboxyl groups becomes ionically bound to a nitrogen atom within the same group; or it may be an external salt wherein the ionic salt group is formed with a nitrogen atoms is not part of the same molecule. The product of the reaction between components (C)(I) and (C)(II) can also include other compounds such as imides, amides, and esters, but at least one salt must be present as the reaction product of (C)(I) and (C)(II). In one embodiment, (C)(II) is a hydroxyamine, the product of the reaction between components (C)(I) and (C)(II) is a half ester and half salt, i.e., an ester/salt.

The reaction between components (C)(I) and (C)(II) is carried out under conditions that provide for the formation of the desired salt. Typically, one or more of components (C)(I) and one or more of components (C)(II) are mixed together and heated to a temperature in the range of from about 50° C. to about 130° C., preferably from about 80° C. to about 110° C.; optionally in the presence of a normally liquid, substantially inert organic liquid solvent/diluent, until the desired product has formed. Components (C)(I) and (C)(II) are reacted in amounts sufficient to provide from about 0.3 to about 3 equivalents of component (C)(II) per equivalent of component (C)(I).

In one embodiment, component (C) is made by reacting a polyisobutene substituted succinic acylating agent (C)(I), said acylating agent having an average of at least 1–3 succinic groups for each equivalent of the polyisobutene group, the polybutene group having a number average molecular weight of about 500 to about 5000; with N,N-dimethylethanolamine (C)(II) in an equivalent ratio (i.e. carbonyl to amine ratio)of about 1 about (0.4–1.25) respectively, and in one embodiment an equivalent ratio of about 1:1 respectively.

In one embodiment, the component (C) is made by reacting the polyisobutene substituted succinic acylating agent (C)(I) with diethanolamine (C)(II) in an equivalent ratio of about 1: about (0.4–1.25) respectively, and in one embodiment in an equivalent ratio of about 1:1 respectively.

In one embodiment, component (C) is made by reacting a hexadecenyl succinic anhydride (C)(I) with N,N-dimethylethanolamine (C)(II) in an equivalent ratio of about 1: about (0.4–0.6) (which also corresponds to a mole ratio of about 1: about (0.8–1.2)) respectively, and in one embodiment in an equivalent ratio of about 1:0.5 (mole ratio of about 1:1) respectively.

In one embodiment, where the acylating agent (component (C)(I)) is made by coupling (a) at least one polyisobutene substituted succinic acid or anhydride, the polyisobutene substituent of the succinic acid or anhydride having abut 50 to about 200 carbon atoms; and (b) at least one hydrocarbyl substituted succinic acid or anhydride, the hydrocarbyl substituent of the succinic acid or anhydride having about 8 to about 25 carbon atoms, and in one embodiment about 10 to about 20 carbon atoms, and in one embodiment about 16 carbon atoms; with (c) ethylene glycol, the ratio of equivalents of (a) to (b) is about 1: about (2.3–2.7), (which also corresponds to the Same mole ratio) and in one embodiment about 1:2.5. In one embodiment, with the ratio of equivalents of (a) to (b) being about 1: about (2.3–2.7), the ratio of equivalents of components [(a)+(b)] to (c) is about (1.8–2.2):1, and in one embodiment about 2:1. In one embodiment, the acylating agent (C)(I) with the above ratio of (a) to (b) (about 1: about (2.3–2.7)), and the above ratio of [(a)+(b)] to (c) (about (1.8–2.2):1), is reacted with dimethylethanolamine (C)(II) in a mole ratio of ethylene glycol to dimethylethanolamine of about 1: (about 1.8–2.2), and in one embodiment about 1:2.

Specific examples of exemplary preparations of nitrogen-containing salt emulsifiers (C) useful in the present water-blended fuel compositions may be found in the "Examples" section, in the '753, and '175 patents, and in EP 0 561 600 A2.

Additional Embodiment of Component (C) In one embodiment, component (C), is a fuel-soluble salt composition comprised of (I) a first polycarboxylic acylating agent, said first polycarboxylic acylating agent having at least one hydrocarbyl substituent of about 20 to about 500 carbon atoms, (II) a second polycarboxylic acylating agent, said second polycarboxylic acylating agent optionally having at least one hydrocarbyl substituent of up to about 500 carbon atoms, said polycarboxylic acylating agents (I) and (II) being coupled together by a linking group (III) derived from a linking compound having two or more primary amino groups, two or more secondary amino groups, at least one primary amino group and at least one secondary amino group, at least two hydroxyl groups, or at least one primary or secondary amino group and at least one hydroxyl groups, said polycarboxylic acylating agents (I) and (II) forming a salt with (IV) ammonia or an amine.

The hydrocarbyl substituent of the first acylating agent (I) may have about 30 to about 500 carbon atoms, and in one embodiment about 40 to about 500 carbon atoms, and in one embodiment about 50 to about 500 carbon atoms.

The optional hydrocarbyl substituent of the second acylating agent (II) may have 1 to about 500 carbon atoms, and in one embodiment about 6 to about 500 carbon atoms, and in one embodiment about 12 to about 500 carbon atoms, and in one embodiment about 18 to about 500 carbon atoms, and in one embodiment about 24 to about 500 carbon atoms, and in one embodiment about 30 to about 500 carbon atoms, and in one embodiment about 40 to about 500 carbon atoms, and in one embodiment about 50 to about 500 carbon atoms.

The hydrocarbyl substituent of the second acylating agent (II) may be derived from an alpha-olefin or an alpha-olefin fraction. The alpha-olefins include 1-dodecene, 1-tridecene, 1-tetradecene, 1-pentadecene, 1-hexadecene, 1-heptadecene, 1-octadecene, 1-eicosene, 1-docosene, 1-triacontene, and the like. The alpha olefin fractions that are useful include $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{18-24}$ alpha-olefins, $C_{18-30}$ alpha-olefins, and the like. Mixtures of two or more of any of the foregoing alpha-olefins or alpha-olefin fractions may be used.

The hydrocarbyl groups of the first and second acylating agents (I) and (II) independently may be derived from an olefin oligomer or polymer. The olefin oligomer or polymer may be derived from an olefin monomer of 2 to about 10 carbon atoms, and in one embodiment about 3 to about 6 carbon atoms, and in one embodiment about 4 carbon atoms. Examples of the monomers include ethylene; propylene; butene-1; butene-2; isobutene; pentene-1; heptene-1; octene-1; nonene-1; decene-1; pentene-2; or a mixture of two of more thereof.

The hydrocarbyl groups of the first and/or second acylating agents (I) and (II) independently may be polyisobutene groups of the same or different molecular weights. Either or both of the polyisobutene groups may be made by the polymerization of a $C_4$ refinery stream having a butene content of about 35 to about 75% by weight and an isobutene content of about 30 to about 60% by weight.

The hydrocarbyl groups of the first and/or second acylating agents (I) and (II) independently may be polyisobutene groups derived from a polyisobutene having a high methylvinylidene isomer content, that is, at least about 50% by weight, and in one embodiment at least about 70% by weight methylvinylidenes. Suitable high methylvinylidene polyisobutenes include those prepared using boron trifluoride catalysts. The preparation of such polyisobutenes in which the methylvinylidene isomer comprises a high percentage of the total olefin composition is described in U.S. Pat. Nos. 4,152,499 and 4,605,808, the disclosure of each of which are incorporated herein by reference. An advantage of using these high methylvinylidene isomers is that the acylating agents (I) and (II) can be formed using a chlorine-free process which is significant when the fuel composition to which they are to be added is required to be a chlorine-free or low-chlorine fuel.

In one embodiment, each of the hydrocarbyl substituents of each of the acylating agents (I) and (II) is a polyisobutene group, and each polyisobutene group independently has a number average molecular weight in the range of about 500 to about 3000, and in one embodiment about 900 to about 2400.

The hydrocarbyl substituent of the acylating agent (I) may be a polyisobutene group having a number average molecular weight of about 2000 to about 2600, and in one embodiment about 2200 to about 2400, and in one embodiment about 2300. The hydrocarbyl substituent of the acylating agent (II) may be a polyisobutene group having a number average molecular weight of about 700 to about 1300, and in one embodiment about 900 to about 1100, and in one embodiment about 1000.

The linking group (III) for linking the first acylating agent (I) with the second acylating agent (II) may be derived from a polyol, a polyamine or a hydroxyamine. The polyol may be a compound represented by the formula $$R—(OH)_m$$

wherein in the foregoing formula, R is an organic group having a valency of m, R is joined to the OH groups through carbon-to-oxygen bonds, and m is an integer from 2 to about 10, and in one embodiment 2 to about 6. The polyol may be a glycol. The alkylene glycols are useful. Examples of the polyols that may be used include ethylene glycol, diethylene glycol, triethylene glycol, tetraethylene glycol, propylene glycol, dipropylene glycol, tripropylene glycol, dibutylene glycol, tributylene glycol, 1,2-butanediol, 2,3-dimethyl-2,3-butanediol, 2,3-hexanediol, 1,2-cyclohexanediol, pentaerythritol, dipentaerythritol, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,66-tetrakis-(hydroxymethyl) cyclohexanol, 1,10-decanediol, digitalose, 2-hydroxymethyl-2-methyl-1, 3-propanediol-(tri-methylolethane), or 2-hydroxymethyl-2-ethyl-1,3-propanediol-(trimethylopropane), and the like. Mixtures of two or more of the foregoing can be used.

The polyamines useful as linking compounds (III) for linking the acylating agents (I) and (II) may be aliphatic, cycloaliphatic, heterocyclic or aromatic: compounds. Especially useful are the alkylene polyamines represented by the formula

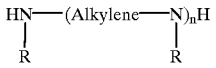

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. Specific examples of such polyamines include ethylene diamine, triethylene tetramine, propylene diamine, trimethylene diamine, tripropylene tetramine, tetraethylene pentamine, hexaethylene heptamine, pentaethylene hexamine, or a mixture of two or more thereof.

Ethylene polyamines, such as some of those mentioned above, are useful as the linking compounds (III). Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines.

The hydroxyamines useful as linking compounds (III) for linking the acylating agents (I) and (II) may be primary or secondary amines. The terms "hydroxyamine" and "aminoalcohol" describe the same class of compounds and, therefore, can be used interchangeably. In one embodiment, the hydroxyamine is (a) an N-(hydroxyl-substituted hydrocarbyl) amine, (b) a hydroxyl-substituted poly (hydrocarbyloxy) analog of (a), or a mixture of (a) and (b). The hydroxyamine may be an alkanol amine containing from 1 to about 40 carbon atoms, and in one embodiment 1 to about 20 carbon atoms, and in one embodiment 1 to about 10 carbon atoms.

The hydroxyamines useful as the linking compounds (III) may be a primary or secondary amines, or a mixture of two or more thereof. These hydroxyamines may be represented, respectfully, by the formulae:

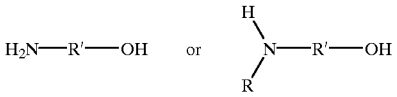

wherein each R is independently a hydrocarbyl group of one to about eight carbon atoms or hydroxyl-substituted hydrocarbyl group of two to about eight carbon atoms and R' is a divalent hydrocarbon group of about two to about 18 carbon atoms. Typically each R is a lower alkyl group of up to seven carbon atoms. The group —R'—OH in such formulae represents the hydroxyl-substituted hydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group.

The hydroxyamines useful as the linking compound (III) may be ether N-(hydroxy-substituted hydrocarbyl)amines. These may be hydroxyl-substituted poly(hydrocarbyloxy) analogs of the above-described hydroxy amines (these analogs also include hydroxyl-substituted oxyalkylene analogs). Such N-(hydroxyl-substituted hydrocarbyl) amines may be conveniently prepared by reaction of epoxides with afore-described amines and may be represented by the formulae:

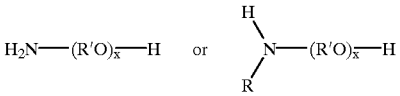

wherein x is a number from about 2 to about 15, and R and R' are as described above.

The hydroxyamine useful as the linking compound (III) for linking the acylating agents (I) and (II) may be one of the hydroxy-substituted primary amines described in U.S. Pat. No. 3,576,743 by the general formula $$R_a—NH_2$$

wherein $R_a$ is a monovalent organic group containing at least one alcoholic hydroxy group. The total number of carbon atoms in $R_a$ preferably does not exceed about 20. Hydroxy-substituted aliphatic primary amines containing a total of up to about 10 carbon atoms are useful. The polyhydroxy-substituted alkanol primary amines wherein there is only one amino group present (i.e., a primary amino group) having one alkyl substituent containing up to about 10 carbon atoms and up to about 6 hydroxyl groups are useful. These alkanol primary amines correspond to $R_a—NH_2$ wherein $R_a$ is a mono-O or polyhydroxy-substituted alkyl group. It is desirable that at least one of the hydroxyl groups be a primary alcoholic hydroxyl group. Specific examples of the hydroxy-substituted primary amines include 2-amino-1-butanol, 2-amino-2-methyl-1-propanol ,p-(beta-hydroxyethyl)-aniline, 2-amino-1-propanol, 3-amino-1-propanol,2-amino-2-methyl-1,3-propanediol, 2-amino-2-ethyl-1,3-propanediol,N-(betaydroxypropyl)—N'-(beta-aminoethyl)-pi perazine, tris-(hydroxymethyl) aminomethane (also known as trismethylolaminomethane), 2-amino-1-butanol, ethanolamine,beta-(beta-hydroxyethoxy)-ethylamine, glucamine, glusoamine, 4-amino-3-hydroxy-3-methyl-1-butene (which can be prepared according to procedures known in the art by reacting isopreneoxide with ammonia), N-3(aminopropyl)-4-(2-hydroxyethyl)-piperadine,2-amino-6-methyl-6-heptanol, 5-amino-1-pentanol, N-(beta-hydroxyethyl)-1,3-diamino propane, 1,3-diamino-2-hydroxypropane, N-(beta-hydroxy ethoxyethyl)-ethylenediamine, trismethylol aminomethane and the like.

Hydroxyalkyl alkylene polyamines having one or more hydroxyalkyl substituents on the nitrogen atoms may be used as the linking compound (III) for linking the acylating agents (I) and (II). Useful hydroxyalkyl-substituted alkylene polyamines include those in which the hydroxyalkyl group is a lower hydroxyalkyl group, i.e., having less than eight carbon atoms. Examples of such hydroxyalkyl-substituted polyamines include N-(2-hydroxyethyl) ethylene diamine, N,N-bis(2-hydroxyethyl) ethylene diamine, 1-(2-hydroxyethyl)-piperazine, monohydroxypropyl-substituted diethylene triamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino groups or through hydroxy groups are likewise useful. Condensation through amino groups results in a higher amine accompanied by removal of ammonia and condensation through the hydroxy groups results in products containing ether linkages accompanied by removal of water.

The amines (IV) which are useful along with ammonia in forming a salt with the acylating agents (I) and (II) include the amines and hydroxyamines discussed above as being useful as linking compounds (III) for linking the acylating agents (I) and (II). Also included are primary and secondary monoamines, tertiary mono- and polyamines, and tertiary alkanol amines. The tertiary amines are analogous to the primary amines, secondary amines and hydroxyamines discussed above with the exception that they may be either mono-amines or polyamines and the hydrogen atoms in the H—N< or —$NH_2$ groups are replaced by hydrocarbyl groups.

The monoamines useful as the amines (IV) for forming a salt with the acylating agents (I) and (II) may be represented by the formula

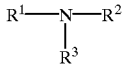

wherein $R^1$, $R^2$ and $R^3$ are the same or different hydrocarbyl groups. Preferably, $R^1$, $R^2$ and $R^3$ are independently hydrocarbyl groups of from 1 to about 20) carbon atoms, and in one embodiment from 1 to about 10 carbon atoms. Examples of useful tertiary amines include trimethyl amine, triethyl amine, tripropyl amine, tributyl amine, monomethyidiethylamine, monoethyidimethyl amine, dimethylproply amine, dimethylbutyl amine, dimethylpentyl amine, dimethylhexyl amine, dimethylheptyl amine, dimethyloctyl amine, dimethyinonyl amine, dimethyidecyl amine, dimethylphenyl amine, N,N-dioctyl-1-octanamine, N,N-didodecyl-1-dodecanamine, tricoco amine, trihydrogenated-tallow amine, N-methyl-dihydrogenated tallow amine, N,N-dimethyl-1-dodecanamine, N,N-dimetyl-1-tetradecanamine, N,N-dimethyl-1-hexadecanamine, N,N-dimethyl-1-octadecanamine, N,N-dimethylcocoamine, N,N-dimethylsoyaamine, N,N-dimethylhydrogenated tallow amine, etc.

Tertiary alkanol amines which are useful as the amines (IV) for forming a salt with the acylating agents (I) and (II) include those represented by the formula

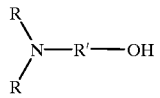

wherein each R is independently a hydrocarbyl group of one to about eight carbon atoms or hydroxyl-substituted hydrocarbyl group of two to about eight carbon atoms and R' is a divalent hydrocarbyl group of about two to about 18 carbon atoms. The groups —R'—OH in such formula represents the hydroxyl-substituted hydrocarbyl groups. R' may be an acyclic, alicyclic or aromatic group. Typically, R' is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines, and the like. Typically, however, each R is a low alkyl group of up to seven carbon atoms. A useful hydroxyamine is dimethylaminoethanol. The hydroxyamines can also be ether N-(hydroxy-substituted hydrocarbyl)amines. These are hydroxyl-substituted poly(hydrocarbyloxy) analogs of the above-described hydroxy amines (these analogs also include hydroxyl-substituted oxyalkylene analogs). Such N-(hydroxyl-substituted hydrocarbyl) amines can be conveniently prepared by reaction of epoxides with aforedescribed amines and can be represented by the formula:

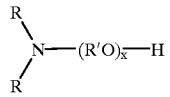

wherein x is a number from about 2 to about 15 and R and R' are described above.

Polyamines which are useful as the amines (IV) for forming a salt with the acylating agents (I) and (II) include the alkylene polyamines discussed above as well as alkylene polyamines with only one or no hydrogens attached to the nitrogen atoms. Thus, the alkylene polyamines useful as the amine (IV) include those conforming to the formula:

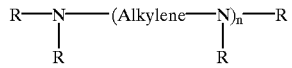

wherein n is from 1 to about 10, preferably from 1 to about 7; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 50 carbon atoms, and in one embodiment up to about 30 carbon atoms; and the "Alkylene" group has from 1 to about 18 carbon atoms, and in one embodiments from 1 to about 6 carbon atoms.

These salt compositions may be prepared by initially reacting the acylating agents (I) and (II) with the linking compound (III) to form an intermediate, and thereafter reacting the intermediate with the ammonia or amine (IV) to form the desired salt. An alternative method involves reacting the acylating agent (I) and ammonia or amine (IV) with each other to form a first salt moiety, separately reacting the acylating agent (II) and ammonia or amine (IV) (which can be the same or different ammonia or amine reacted with the acylating agent (I)) with each other to form a second salt moiety, then reacting a mixture of these two salt moieties with the linking compound (III).

The ratio of reactants ultilized in the preparation of these salt compositions may be varied over a wide range. Generally, for each equivalent of each of the acylating agents (I) and (II), at least about one equivalent of the linking compound (III) is used. From about 0.1 to about 2 equivalents or more of ammonia or amine (IV) are used for each equivalent of the acylating agents (I) and (II), respectively. The upper limit of linking compound (III) is about 2 equivalents of linking compound (III) for each equivalent of acylating agents (I) and (II). Generally the ratio of equivalents of acylating agent (I) to the acylating agent (II) is about 0.5 to about 2, with about 1:1 being useful. Useful amounts of the reactants include about 2 equivalents of the linking compound (III), and from about 0.1 to about 2 equivalents of the ammonia or amine (IV) for each equivalent of each of the acylating agents (I) and (I).

The number of equivalents of the acylating agents (I) and (II) depends on the total number of carbyoxylic functions present in each. In determining the number of equivalents for each of the acylating agents (I) and (II), those carboxyl functions which are not capable of reacting as a carboxylic acid acylating agent are excluded. In general, however, there is one equivalent of each acylating agent (I) and (II) for each carboxy group in the acylating agents. For example, there would be two equivalents in an anhydride derived from the reaction of one mole of olefin polymer and one mole of maleic anhydride.

The weight of an equivalent of a polyamine is the molecular weight of the polyamine divided by the total number of nitrogens present in the molecule. If the polyamine is to be used as linking compound (III), tertiary amino groups are not counted. One the other hand, if the polyamine is to used as a salt forming amine (IV), tertiary amino groups are counted. The weight of an equivalent of a commercially available mixture of polyamines can be determined by dividing the atomic weight of nitrogen (14) by the % N contained in the polyamine; thus, a polyamine mixture having a % N of 34 would have an equivalent weight of 41.2. The weight of an equivalent of ammonia or a monoamine is equal to its molecular weight.

The weight of an equivalent of a polyol is its molecular weight divided by the total number of hydroxyl groups present in the molecule. Thus, the weight of an equivalent of ethylene glycol is one-half its molecular weight.

The weight of an equivalent of a hydroxyamine which is to be used as a linking compound (III) is equal to its molecular weight divided by the total number of —OH, >NH and —$NH_2$ groups present in the molecule. On the other hand, if the hydroxyamine is to be used as a salt forming amine (IV), the weight of an equivalent thereof would be its molecular weight divided by the total number of nitrogen groups present in the molecule.

The acylating agents (I) and (II) may be reacted with the linking compound (III) according to conventional ester and/or amide-forming techniques. This normally involves heating acylating agents (I) and (II) with the linking compound (III), optionally in the presence of a normally liquid, substantially inert, organic liquid solvent/diluent. Temperatures of at least about 30° C. up to the decomposition temperature of the reaction component and/or product having the lowest such temperature can be used. This temperature may be in the range of about 50° C. to about 130° C., and in one embodiment about 80° C. to about 100° C. when the acylating agents (I) and (II) are anhydrides. On the other hand, when the acylating agents (I) and (II) are acids, this temperature is typically in the range of about 100° C. to about 300° C. with temperatures in the range of about 125° C. to about 250° C. often being employed.

The product made by this reaction is typically in the form of statistical mixture that is dependent on the charge of each of the acylating agents (I) and (II), and on the number of reactive sites on the linking compound (III). Foir example, if an equal molar ratio of acylating agents (I) and (II) is reacted with ethylene glycol, the product would be comprised of a mixture of (1) 50% of compounds wherein one molecule of the acylating agent (I) is linked to one molecule of the acylating agent (II) through the ethylene glycol; (2) 25% of compounds wherein two molecules of the acylating agent (I) are linked together through the ethylene glycol; and (3) 25% of compounds wherein two molecules of the acylating agent (II) are linked together through the ethylene glycol.

The reactions between the acylating agents (I) and (II), and the salt forming ammonia or amine (IV) are carried out under salt forming conditions using conventional techniques. Typically, these components are mixed together and heated to a temperature in the range of about 20° C. up to the decomposition temperature of the reaction component and/or product having the lowest such temperature, and in one embodiment about 50° C. to about 130° C., and in one embodiment about 80° C. to about 110° C.; optionally, in the presence of a normally liquid, substantially inert organic liquid solvent/diluent, until the desired salt product has formed.

The following examples are provided to illustrate the preparation of the component (C) discussed above.

EXAMPLE C-1

A twelve-liter, four-neck flask is charged with Adibis ADX 101G (7513 grams). Adibis ADX 101G, which is a product available from Lubrizol Adibis, is comprised of a polyisobutene substituted succinic anhydride mixture wherein 60% by weight is a first polyisobutene substituted succinic anhydride wherein the polyisobutene substituent has a number average molecular weight of 2300 and is derived from a polyisobutene having methylvinylidene isomer content of 80% by weight, and 40% by weight is a second polyisobutene substituted succinic anhydride wherein the polyisobutene substituent has a number average molecular weight of 1000 and is derived from a polyisobutene having methylvinylidene isomer content of 85% by weight. The product has a diluent oil content of 30% by weight and a succination ratio of 1.4 (after correcting for unreacted polyisobutene). The flask is equipped with an overhead stirrer, a thermocouple, an addition funnel topped with an $N_2$inlet, and a condenser. The succinic anhydride mixture is stirred and heated at 95° C., and ethylene glycol (137 grams) is added via the addition funnel over five minutes. The resulting mixture is stirred and maintained at 102–107° C. for 4 hours. Dimethylaminoethanol (392 grams) is charged to the mixture over 30 minutes such that the reaction temperature does not exceed 107° C. The mixture is maintained at 100–105° C. for 2 hours, and filtered to provide a brown, viscous product.

EXAMPLE C-2

A three-liter, four-neck flask is charged with Adibis ADX 101 G (1410 grams). The flask is equipped with an overhead stirrer, a thermocouple, an addition funnel topped with an $N_2$ inlet, and a condenser. The succinic anhydride mixture is stirred and heated to 61° C. Ethylene glycol (26.3 grams) is added via the addition funnel over five minutes. The resulting mixture is stirred and heated to 105–110° C. and maintained at that temperature for 4.5 hours. The mixture is cooled to 96° C., and dimethylaminoethanol (77.1 grams) is charged to the mixture over 5 minutes such that the reaction temperature does not exceed 100° C. The mixture is maintained at 95° C. for 1 hour, and then at 160° C. for 4 hours. The product is a brown, viscous product.

Component (C) may be present in the emulsified water-blended fuel compositions of the invention at a concentration of about 0.1 to about 15% by weight, and an one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The Amine Salt (D)

Another component of the present composition is a water-soluble, ashless (i.e. metal-free), halogen-, boron-, and phosphorus-free amine salt, distinct from component (C). The term "amine" as used herein includes ammonia.

In one embodiment, the amine salt (D) is represented by the formula $$k[G(NR_3)_y]^{y+}nX^{P-} \qquad \text{(D-I)}$$

Wherein in formula (D-I), G is hydrogen, or an organic neutral radical of 1 to about 8 carbon atoms, and in one embodiment 1 to 2 carbon atoms, having a valence of y; each R independently is hydrogen or a hydrocarbyl group of 1 to about 10 carbon atoms, and in one embodiment 1 to about 5 carbon atoms, and in one embodiment 1 to 2 carbon atoms; $X^{P-}$ is an anion having a valence of p; and k, y, n and p are independently at least 1, provided that when G is H, y is 1, and further provided that the sum of the positive charge $ky^+$ is equal to the sum of the negative charge $nX^{P-}$, such that the amine salt (D) is electrically neutral. In one embodiment, is a hydrocarbyl or hydrocarbylene group of 1 to about 5 carbon, and in one embodiment 1 to 2 carbon atoms. In one embodiment, $X^{y-}$ is a nitrate ion (y=1); in one embodiment it is an acetate ion (y=1). Suitable examples of the amine salt include ammonium nitrate ($NH_3.HNO_3$), ammonium acetate ($NH_3.HOC(O)CH_3$), methylammonium nitrate ($CH_3NH_2.HNO_3$), methylammonium acetate ($CH_3NH_2.HOOCCH_3$), ethylene diamine diacetate ($H_2NCH_2CH_2NH_2.2HOOCCH_3$), urea nitrate ($H_2NC(O)NH_2.HNO_3$), and urea dintrate ($H_2NC(O)NH_2.2HNO_3$).

As an illustration of formula (D-I), ethylene diamine diacetate can be written in its ionic form as $$[H_3NCH_2CH_2NH_3]^{2+}2CH_3CO_2^-$$

In this case, in formula (D-I), G is —$CH_2CH_2$—; R is hydrogen; y is 2; n is 2; p is 1; and $X^{P-}$ is $CH_3CO_2^-$ In one embodiment, the amine salt (D) of the present composition functions as an emulsion stabilizer, i.e., it acts to stabilize the present emulsified water-blended fuel composition. Compositions with the amine salt (D) have longer stability as emulsions than the compositions without the amine salt (D).

In one embodiment, the amine salt (D) functions as a combustion improver. A combustion improver is characterized by its ability to increase the mass burning rate of water-blended fuel composition. It is known that the presence of water in fuels reduces the power output of an internal combustion engine. The presence of a combustion improver has the effect of improving the power output of an engine. The improved power output of the engine can often be seen in a plot of mass burning rate versus crank angle (which angle corresponds to the number of degrees of revolution of the crankshaft which is attached to the piston rod, which in turn is connected to pistons). One such plot is shown in FIG. 2, and which is discussed further under "Examples" below. The mass burning rate will be higher for a fuel with a combustion modifier than for a fuel lacking the combustion modifier. This improved power output caused by the presence of a combustion improver is to be distinguished from improvement in ignition delay caused by a cetane improver. Although some cetane improvers may function as a combustion improver, and some combustion improvers as cetane improvers, the actual performance characteristics or effects of combustion improvement are clearly distinct from improvements in ignition delay. Improving ignition delay generally relates to changing the onset of combustion (i.e. they will affect where on the x-axis of FIG. 1 the peak mass burning rate will occur) whereas improving the power output relates to improving the peak cylinder pressure (i.e., the amplitude of the peak mass burning rate on the y-axis of FIG. 1.)

The amine salt (D) is present at a level of about 0.001 to about 15%, and in one embodiment from about 0.001 to about 1%, in one embodiment about 0.05 to about 5%, in one embodiment about 0.5 to about 3%, and in one embodiment about 1 to about 10% by weight of the emulsified water-blended fuel composition.

OTHER OPTIONAL COMPONENTS OF THE COMPOSITION

The Cosurfactants (E)

In addition to the presence of component (C) as an emulsifier, the present composition can also contain other emulsifiers, which may be present as cosurfactants. These emulsifiers/cosurfactants comprise ionic or nonionic compounds, having a hydrophilic lipophilic balance (HLB) in the range of about 2 to about 10, and in one embodiment about 4 to about 8. Examples of these emulsifiers are disclosed in *McCutcheon's Emulsifiers and Detergents*, 1993, North American & International Edition. Some generic examples include alkanolamides, alkylarylsulfonates, amine oxides, poly(oxyalkylene) compounds, including block copolymers comprising alkylene oxide repeat units (e.g., Pluronic™ s), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkyl phenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

In one embodiment, the cosurfactant is a poly(oxyalkene) compound, and in one embodiment, the polyoxyalkylene compound is a copolymer of ethylene oxide and propylene oxide copolymer. In one embodiment, this copolymer is a triblock copolymer represented by the formula (E-1)

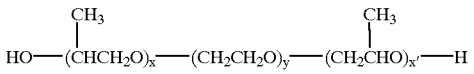

wherein in formula (E-I), x and x' are the number of repeat units of propylene oxide and y is the number of repeat units of ethylene oxide, as shown in the formula. This triblok copolymer is available from BASF Corporation under the name "PLURONIC™R" surfactants. In one embodiment, the triblock copolymer has a number average molecular weight of about 1800 to about 3000. In one embodiment, the triblock copolymer has a number average molecular weight of about 2150, is a liquid at 20° C., having a melt/pour point of about −25° C., has Brookfield viscosity of 450 cps, and has surface tensions (25° C.) at 0.1, 0.01, and 0.001% concentration of about 41.9, 44.7, and 46.0 dynes/cm respectively. It is available under the name "PLURONIC™ 17R2". In one embodiment, the triblock copolymer has a number average molecular weight of about 2650, is a liquid at 20° C., having a melt/pour point of about −18° C., has Brookfield viscosity of 600 cps, and has surface tensions (25° C.) at 0.1, 0.01, and 0.001% concentration of about 44.1, 44.5, and 51.4 dynes/cm respectively. It is available under the name "PLURONIC™ 17R4".

In one embodiment, the poly(oxyalkylene) compound is an alcohol ethoxylate represented by the formula $RO(CH_2CH_2O)_nH$ wherein R is a hydrocarbyl group of 8 to 30 carbon atoms, and in one embodiment about 8 to about 20, and in one embodiment about 10 to about 16 carbon atoms; and n ranges from about 2 to about 100, and in one embodiment about 2 to about 20, and in one embodiment about 2 to about 10. In one embodiment R is nonylphenyl, and in one embodiment, R is nonylphenyl and n is about 4. It is available from Rhone-Poulenc, under the name "IGEPAL™CO-430". It has about 44% ethylene oxide, has an HLB value of about 8.8. It is an aromatic odor, is pale yellow liquid, having a density at 25° C. of 1.02, viscosities at 25° C. and 100° C. of about (160–260) and (8–10) respectively; solidification point of −21±2; and a pour point of −16±2° F. In one embodiment, R is nonylphenyl and n is about 6. It is available from Rhone-Poulenc, under the name "IGEPAL™CO-530". It has about 54% ethylene oxide, has an HLB value of about 10.8. It is an aromatic odor, is pale yellow liquid, having a density at 25° C. of 1.04, viscosities at 25° C. and 100° C. of about (180–280) and (10–12) respectively; solidification point of −23±2° F.; and a pour point of −18±2° F.

In one embodiment, R in the above alcohol ethoxylate is a linear $C_{9-11}$ alkyl group and n ranges from about 2 to about 10, and in one embodiment from about 2 to about 6. These alcohol ethoxylates are available from Shell International Petroleum Company under the name "NEODOL™" alcohol ethoxylates. In one embodiment, n is about 2.7. It is available under the name "NEODOL™91-2.5." It has a number average molecular weight of about 281, an ethylene oxide content of about 42.3% by weight, a melting range of about −31 to −2° F., a specific gravity (77° F.) of about 0.925, viscosity at 100° F. of about 12 cSt, a hydroxyl number of about 200 mg KOH/g, and an HLB number of about 8.5. In one embodiment, n is about 8.2. It is available under the name "NEODOL™91-8". It has a number average molecular weight of about 519, an ethylene oxide content of about 69.5% by weight, a melting range of about 45 to 68° F., a specific gravity (77° F.) of about 1.008, viscosity at 100° F. of about 39 cSt, a hydroxyl number of about 108 mg KOH/g, and an HLB number of about 8.5.

In one embodiment the cosurfactant comprises at least one sorbitan ester.

The sorbitan esters include sorbitan fatty acid esters wherein the fatty acid component of the ester comprises a carboxylic acid of about 10 to about 100 carbon atoms, and in one embodiment about 12 to about 24 carbon atoms. Sorbitan is a mixture of anhydrosorbitols, principally 1,4-sorbitan and isosorbide:

(E-II)

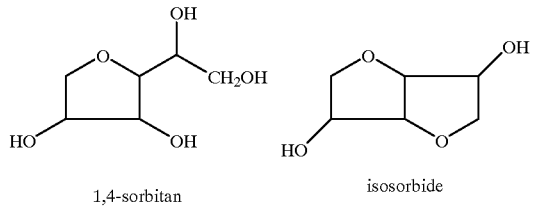

Sorbitan, (also known as monoanhydrosorbitol, or sorbitol anhydride) is a generic name for anhydrides derivable from sorbitol by removal of one molecule of water. The sorbitan fatty acid esters of this invention are a mixture of partial esters of sorbitol and its anhydrides with fatty acids. These sorbitan esters can be represented by the structure below which may be any one of a monoester, diester, triester, tetraester, or mixtures thereof.

(E-III)

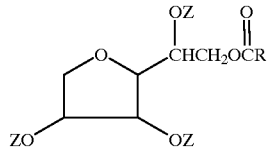

In formula (E-III), each Z independently denotes a hydrogen atom or C(O)R—, and each R mutually independently denotes a hydrocarbyl group of about 9 to about 99 carbon atoms, more preferably about 11 to about 23 carbon atoms. Examples of sorbitan esters include sorbitan stearates and sorbitan oleates, such as sorbitan stearate (i.e., monostearate), sorbitan distearate, sorbitan tristearate, sorbitan monooleate and sorbitan sesquioleate. Sorbitan esters are available commercially under the names Spans™ and Arlacels™ from ICI.

The sorbitan esters also include polyoxyalkylene sorbitan esters wherein the alkylene group has about 2 to about 30 carbon atoms. These polyoxyalkylene sorbitan esters can be represented by the structure (E-IV)

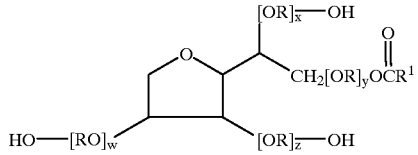

wherein in formula (E-IV), each R independently is an alkylene group of about 2 to about 30 carbon atoms; R' is a hydrocarbyl group of about 9 to about 99 carbon atoms, more preferably about 11 to about 23 carbon atoms; and w, x, y and z represent the number of repeat oxyalkylene units. For example ethoxylation of sorbitan fatty acid esters leads to a series of more hydrophilic: surfactants, which is the result of hydroxy groups of sorbitan reacting with ethylene oxide. One principal commercial class of these ethoxylated sorbitan esters are those containing about 2 to about 80 ethylene oxide units, and in one embodiment from about 2 to about 30 ethylene oxide units, and in one embodiment about 4, in one embodiment about 5, and in one embodiment about 20 ethylene oxide units. They are available from Calgene Chemical under the name "POLYSORBATE™" and from ICI under the name "TWEEN™". Typical examples are polyoxyethylene (hereinafter "POE") (20) sorbitan tristearate (Polysorbate 65; Tween 65), POE (4) sorbitan monostearate (Polysorbate 61; Tween 61), POE (20) sorbitan trioleate (Polysorbate 85; Tween 85), POE (5) sorbitan monooleate (Polysorbate 81; Tween 81), and POE (80) sorbitan monooleate (Polysorbate 80; Tween 80). As used in this terminology, the number within the parentheses refers to the number of ethylene oxide units present in the composition.

In one embodiment, the cosurfactant comprises at least one fatty acid diethanolamide. The fatty acid diethanolamides are 1:1 fatty acid diethanolamides made by reacting a fatty acid with diethanolamide in a 1:1 mole ratio under amide forming conditions. These 1:1 fatty acid diethanolamides are available from Witco Corporation under the name "SCHERCOMID™." The fatty acids used to make these 1:1 fatty acid diethanlomides may be monocarboxylic fatty acids or they may be derived from natural oils (such as triglycerides). Useful fatty acids and their sources include lauric acid, myristic acid, coconut acid, coconut oil, oleic acid, tall oil fatty acid, linoleic acid, soybean oil, apricot kernel oil, wheat germ oil, and mixtures thereof. In one embodiment, the fatty acid diethanolamide is derived from oleic acid. It is available commercially under the name "SCHERCOMID™SO-A" also referred to as "Oleamide DEA". It is a clear amber liquid, has a maximum acid value of about 5, an alkali value of about 40–60, and contains a minimum of 85% amide.

The cosurfactant when present is present in an emulsifying amount, i.e., it is present in a quantity sufficient to maintain the present composition as an emulsion. In one embodiment, it is present at a level of about 0.005 to about 20%, and in one embodiment from about 0.005 to about 10%, and in one embodiment from about 0.005 to about 1%.

The Organic Nitrate Cetane Improver (F)

In one embodiment of the present invention, the present composition further comprises at least one organic cetane improver. The organic nitrate cetane improver includes nitrate esters of substituted or unsubstituted aliphatic or cycloaliphatic alcohols which may be monohydric or polyhydric. Preferred organic nitrates are substituted or unsubstituted alkyl or cycloalkyl nitrates having up to about 10 carbon atoms, preferably from 2 to about 10 carbon atoms. The alkyl group may be either linear or branched, or a mixture of linear or branched alkyl groups. Specific examples of nitrate compounds suitable for use in the present invention include methyl nitrate, ethyl nitrate, n-propyl nitrate, isopropyl nitrate, allyl nitrate, n-butyl nitrate, isobutyl nitrate, sec-butyl nitrate, tertybutyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also suitable are the nitrate esters of alkoxy substituted aliphatic alcohols such as 2-ethoxyethyl nitrate, 2-(2-ethoxy-ethoxy) ethyl nitrate, 1-methoxypropyl–2-nitrate, 4-ethoxybutyl nitrate, etc., as well as diol nitrates such as 1,6-hexamethylene dinitrate. While not particularly preferred, the nitrate esters of higher alcohol may also be useful. Such higher alcohols tend to contain more than about 10 carbon atoms. Preferred are the alkyl nitrates having from about 5 to about 10 carbon atoms, most especially mixtures of primary amyl nitrates, mixtures of primary hexyl nitrates, and octyl nitrates such as 2-ethylhexyl nitrate.

The concentration of the organic nitrate cetane improver in the present composition can be any concentration sufficient to counteract the reduction in cetane number caused by the addition of water in the present water-blended fuel compositions. Generally, addition of water to fuel acts to lower the cetane number of the fuel. As a general rule of thumb, the cetane number of fuel goes down by ½ unit per each 1% addition of water. Lowering of cetane number results in ignition delay, which can be counteracted by the addition of cetane enhancers/improvers. Generally, the amount of organic nitrate cetane improver ester will fall in the range of about 0.05 to about 10% and in one embodiment about 0.05 to about 1% by weight of the water-blended fuel composition.

The Antifreeze (G)

In one embodiment of the present invention, the composition further comprises an antifreeze. The antifreeze is usually an alcohol. Examples of suitable alcohols useful as an antifreeze for the present invention include, but are not limited to ethylene glycol, propylene glycol, methanol, ethanol, and mixtures thereof.

The antifreeze can be present at any concentration sufficient to keep the present composition from freezing within the operable temperature range. In one embodiment, it is present at a level of about 0.1% to about 10%, and in one embodiment, about 0.1 to 5% by weight of the water-blended fuel composition.

EXAMPLES

The preparation of an acylating agent (C)(I) is illustrated in Example 1. Additional examples may be found in the '753 patent, EP 0 561 600 A2, and '175 patent.

Example 1

A mixture of 1000 parts (1.69 equivalents) of the polyisobutene-substituted succinic acylating agent having a ratio of succinic groups to equivalent weights of polyisobutene of about 1.91 (prepared according to Example 1 of EP 0 561 600 A2) and 1151 parts of a 40 Neutral oil are heated to 65–70° C. with stirring. N,N-dimethylethanolamine (151 parts; 1.69 equivalent) is added such that the reaction mixture exotherms to 82° C. The reaction mixture is heated to 93° C. and held at that temperature for 2 hours. The temperature is adjusted to 160° C., and held at that temperature for several hours (10–15 hours), and then filtered and cooled to room temperature to provide the product. The product has a nitrogen content of 0.90% by weight, a total acid number of 13.0, a total base number of 39.5, a viscosity at 100° C. of 50.0 cSt, a viscosity at 40° C. of 660 centistoke (cSt), a specific gravity of 0.925 at 15.6° C., and a flash point of 75° C. The product is an ester/salt.

Example 2

A mixture of 1000 parts (1.69 equivalents) of the polyisobutene-substituted succinic acylating agent of Example 1 and 1039 parts of a 40 Neutral oil are heated to 75–80° C. with stirring. Diethanolamine (125 parts; 1.69 equivalent) is added such that the reaction mixture exotherms to 90° C. The reaction mixture is heated to 116° C. and held at that temperature for a minimum of 4 hours. The reaction mixture is then filtered and cooled to room temperature to provide the product. The product has a nitrogen content of 0.83% by weight, a total acid number of 23.0, a total base number of 23.0, a viscosity at 100° C. of 120 cSt, a viscosity at 40° C. of 5000 cSt, a specific gravity of 0.938 at 15.6° C., and a flash point of 85° C. The product is an ester/salt.

Example 3

A mixture of 1000 parts of polyisobutenyl succinic anhydride ("TLA™-629C" from Texaco, derived from a nominal 1000 molecular weight polyisobutylene; Saponification No.79 mg KOH/g; Kinematic viscosities 24,400 and 400 cSt at 40° and 100° C. respectively) produced by direct alkylation of maleic anhydride (without the use of chlorine), 585 parts of a hexadecenyl succinic anhydride and 121 parts of a 100 Neutral mineral oil are heated to a temperature of 99° C., with stirring and maintained at that temperature for one hour. Thereafter 78 parts of ethylene glycol is added to the mixture. The mixture is maintained at 95–104° C. for 3 hours. Thereafter 225 parts of dimethylethanolamine is added to the mixture over a period of 0.5 hour and the reaction mixture is maintained at 95–104° C. for 2.5 hours and then cooled to 70° C. to provide the desired product. The product is an ester/salt. It has nitrogen content of about 1.75% by weight.

Some illustrative water-blended fuel compositions within the scope of the invention are disclosed in Table 1. The amounts are in parts by weight.

TABLE 1

| Components | A | B | C |
|---|---|---|---|
| Diesel Fuel | 74.5 | 75.8 | 74.9 |
| Water | 20.0 | 20.0 | 20.0 |
| Surfactant 1[1] | 0.12 | 0.50 | 0.75 |
| Surfactant 2[2] | 0.38 | — | — |
| Surfactant 3[3] | — | 0.25 | — |
| Surfactant 4 | — | — | 0.12[5] |
| Organic Solvent[4] | 0.22 | 0.19 | 0.37 |
| 2-Ethylhexyl nitrate | 0.35 | 0.35 | 0.35 |
| Ammonium nitrate | 1.0 | 0.10 | 0.50 |
| Methanol | 3.0 | 3.0 | 3.0 |

[1]Ester/salt prepared by reacting a polyisobutene substituted acylating agent (acylating agent having a ratio of succinic groups to polyisobutene equivalent weight of about 1.7–2.0; Example 1 of EP 0 561 600 A2) with dimethylethanolamine in a equivalent weight ratio of about 1:1 (about 1 mole succinic acid group to about 2 moles of the amine; Product of Example 1)
[2]Ester/salt prepared by reacting a polyisobutene substituted acylating agent (acylating agent having a ratio of succinic groups to polyisobutene equivalent weight of about 1.7–2.0) with diethanolamine in an equivalent ratio of about 1:1 (about 1 mole succinic acid group to about 2 moles of the amine; Product of Example 2 above)
[3]Ester salt prepared by reacting a hexadecenyl succinic anhydride with diethanolamine in a mole ratio of about 1:1.35 respectively.
[4]Aromatic solvent available under the name "SC-150" (Ohio Solvents), having a flash point of 60° C. (PMCC), and initial and final boiling points of 188° C. and 210° C. respectively.
[5]Pluronic 17R2 (BASF Corp.); see specification The advantage of the amine salt (component (D)) of the present invention can be illustrated by FIG. 1. This figure shows the performance of compositions made with (FIG. 1(*b*)) and without (FIG. 1(*a*)) an amine salt (ammonium nitrate). All of the compositions contain diesel fuel, water, and an additive composition consisting of 0.35 weight % of 2-ethylhexyl nitrate, and surfactants 1 and 3 of Table 1, with a weight ratio surfactant 1 to surfactant 3 of 6:1. The compositions are all water-blended fuel macroemulsions, having milky white appearance. The stability of the emulsion is determined visually by tracking what percent of the water-blended fuel composition remains as a white emulsion (at 65° C.) one week from the time the water-blended fuel emulsion is first prepared by mixing of the components. Thus percent white emulsion is plotted against the weight % of the additive composition (containing surfactants, an organic nitrate cetane improver (2-ethylhexylnitrate) and optionally ammonium nitrate).

Figure 2:
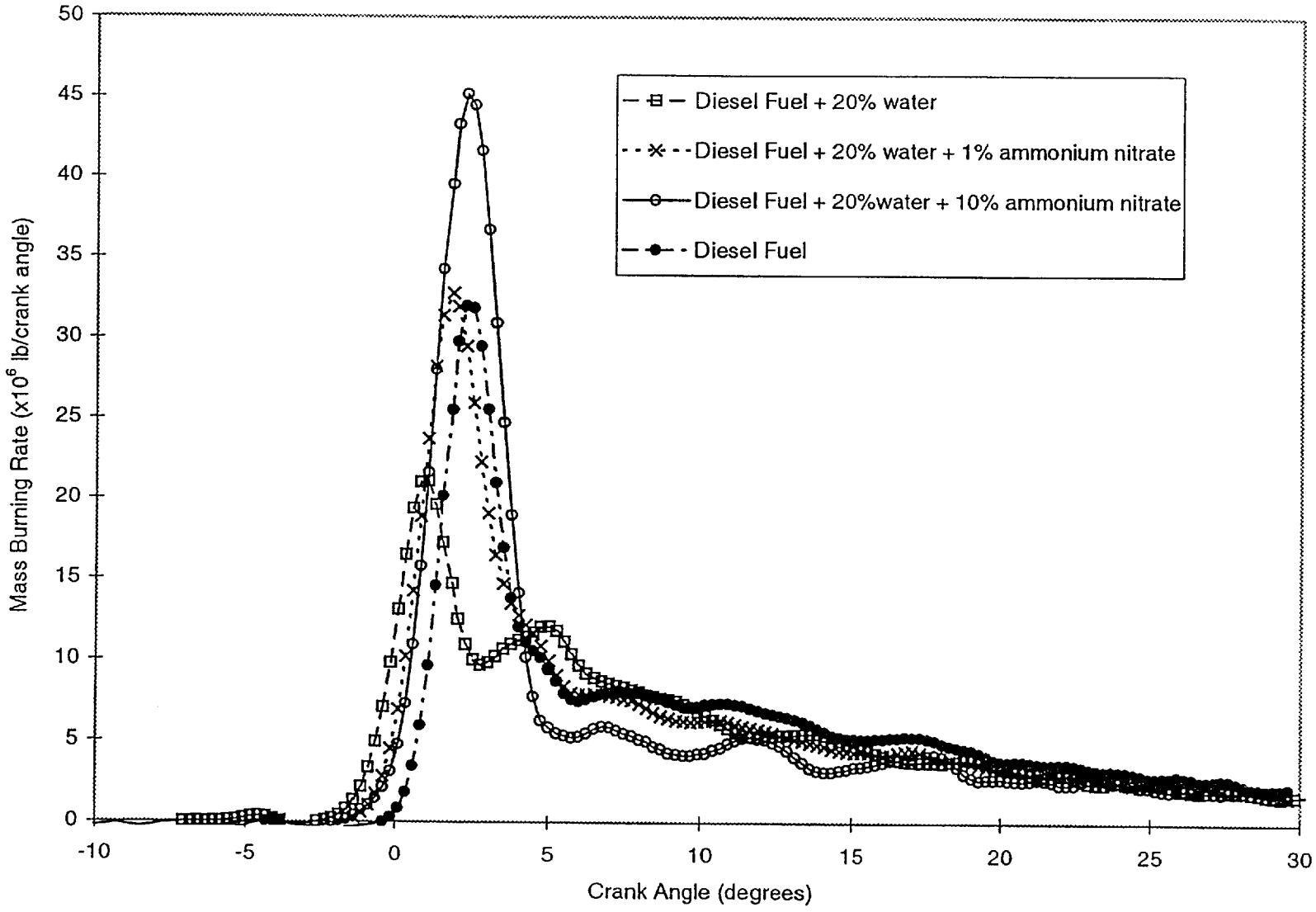
FIG. 2 is a plot of mass burning rate versus crank angle in an internal combustion engine.

It can be seen from FIG. 1 that the compositions with ammonium nitrate have longer stability as emulsions than the compositions without the ammonium nitrate. The differences in stability between the compositions containing ammonium nitrate and those lacking it are more pronounced at lower levels of the additive composition (about 0.4 to about 2.5 weight % additive composition). There is an error of precision of about 10% in the measurement of emulsion stability by this method.

FIG. 2 is a plot of mass burning rate versus crank angle for various fuel compositions. The fuel compositions include 1) diesel fuel itself, 2) water-blended diesel fuel containing 20% water; 3) water-blended diesel fuel containing 20% water and 1% ammonium nitrate; and 4) water-blended diesel fuel containing 20% water and 10% ammonium nitrate. It can be seen from FIG. 2 that the presence of water in diesel fuel not containing any added ammonium nitrate serves to diminish the peak (optimum) mass burning rate compared to pure diesel fuel alone. However, the presence of ammonium nitrate in water-blended diesel fuel serves to increase the peak mass burning rate of water-blended diesel fuel, and hence to offset the loss in power in engines caused by the presence of water in diesel fuel. The magnitude of the increase in peak mass burning rate caused by the presence of ammonium nitrate also depends on the level of the ammonium nitrate. Thus the peak mass burning rate is higher when the ammonium nitrate is present at 10% than when it is present at 1%. The percentages used here relate to percentage by weight of the total water-blended fuel composition.

Example 4

This example is illustrative of concentrates that can be used to make the water-blended fuel compositions of the invention. The numerical values indicated below are in parts by weight. The Surfactant 3 and Oganic Solvent indicated below are the same as indicated in Example 3.

| | D | E |
|---|---|---|
| Product ot Example C-1 | 34 | — |
| Product of Example C-2 | — | 34 |
| Surfactant | 6 | 6 |
| Organic Solvent | 23.2 | 23.2 |
| 2-Ethylhexyl nitrate | 23.8 | 23.8 |
| Aqueous ammonium nitrate (54% by wt ammonium nitrate) | 13 | 13 |

Example 5

This example discloses emulsified water-blended fuel compositions using the concentrates disclosed in Example 4. In the table below all numerical values are in parts by weight.

| | F | G |
|---|---|---|
| Diesel Fuel | 79–81 | 79–81 |
| Water | 18–20 | 18–20 |
| Concentrate D | 1.5–3 | — |
| Concentrate E | — | 1.5–3 |

Each of the documents referred to above is incorporated herein by reference. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil that may be customarily present in the commercial material, unless otherwise indicated. It is to be understood that the amount, range, and ratio limits set forth herein may be combined.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An emulsified water-blended fuel composition comprising:

(A) about 50 to about 99% by weight of a hydrocarbon boiling in the gasoline or diesel range;

(B) about 1 to about 50% by weight of water (C) a minor emulsifying amount of at least one fuel-soluble salt comprised of (I) a first polycarboxylic acylating agent, said first polycarboxylic acylating agent having at least one hydrocarbyl substituent of about 20 to about 500 carbon atoms, (II) a second polycarboxylic acylating agent, said second polycarboxylic acylating agent optionally having at least one hydrocarbyl substituent of up to about 500 carbon atoms, said polycarboxylic acylating agents (I) and (II) being coupled together by (III) a linking group derived from a linking compound having two or more primary amino groups, two or more secondary amino groups, at least one primary amino group and at least one secondary amino group, at least two hydroxyl groups, or at least one primary or secondary amino group and at least one hydroxyl group, said polycarboxylic acylating agents (I) and (II) forming a salt with (IV) ammonia or an amine; and (D) about 0.001 to about 15% by weight of an emulsion stabilizing water-soluble salt distinct from component (C) represented by the formula $$k[G(NR_3)_Y]^{y+}nX^{P-} \quad \text{(D-I)}$$

wherein in formula (D-I), G is hydrogen, or an organic neutral radical of 1 to about 8 carbon atoms having a valence of y; each R independently is hydrogen or a hydrocarbyl group of 1 to about 10 carbon atoms, $X^{P-}$ is an anion having a valence of p; and k, y, n, and p are independently at least 1, provided that when G is H, y is 1; and further provided that the sum of the positive charge $ky^+$ is equal to the sum of the negative charge $np^-$ such that the salt is electrically neutral.

2. The fuel composition of claim 1 wherein said first carboxylic acylating agent (I) is a polyisobutene substituted succinic acid or anhydride, and said second carboxylic acylating agent (II) is a polyisobutene substituted succinic acid or anhydride.

3. The fuel composition of claim 2 wherein the polyisobutene substituent of said acylating agent (I) has a number average molecular weight of about 2000 to about 2600, and the polyisobutene substituent of said acylating agent (II) has a number average molecular weight of about 700 to about 1300.

4. The fuel composition of claim 1 wherein said first acylating agent (I) and said second acylating agent (II) are derived from a polyisobutene having a methylvinylidene isomer content of at least about 50% by weight.

5. The fuel composition of claim 1 wherein said linking compound (III) is a polyol, a polyamine or a hydroxyamine.

6. The fuel composition of claim 1 wherein said amine (IV) is a monoamine, a polyamine or a hydroxyamine.

7. The fuel composition of claim 1 wherein said linking compound (III) is ethylene glycol.

8. The fuel composition of claim 1 wherein said amine (IV) is dimethylamino ethanol.

9. The fuel composition of claim 1 wherein said salt (C) is comprised of (I) a first polyisobutene substituted succinic acid or anhydride, the polyisobutene substituent of said first acid or anhydride having a number average molecular weight of about 2000 to about 2600, (II) a second polyisobutene substituted succinic acid or anhydride, the polyisobutene substituent of said second acid or anhydride having a number average molecular weight of about 700 to about 1300, said polyisobutene substituted succinic acids or anhydrides (I) and (II) being coupled together by (III) a linking group derived from ethylene glycol, said polyisobutene substituted succinic acids or anhydrides (I) and (II) forming a salt with ammonia or an amine.

10. The fuel composition of claim 1 wherein Component (D) is ammonium nitrate.

11. A process for fueling an internal combustion engine comprising fueling said engine with the fuel composition of claim 1.

* * * * *